US008833455B2

(12) United States Patent
Orban et al.

(10) Patent No.: US 8,833,455 B2
(45) Date of Patent: Sep. 16, 2014

(54) METHOD AND APPARATUS FOR WELL TREATMENT

(75) Inventors: Jacques Orban, Moscow (RU); Dominique Guillot, Fontenay-aux-Roses (FR); Hervé Anxionnaz, Fontenay-aux-Roses (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 1784 days.

(21) Appl. No.: 11/718,078

(22) PCT Filed: Oct. 26, 2005

(86) PCT No.: PCT/EP2005/011608
§ 371 (c)(1), (2), (4) Date: Mar. 2, 2009

(87) PCT Pub. No.: WO2006/048210
PCT Pub. Date: May 11, 2006

(65) Prior Publication Data

US 2009/0173500 A1 Jul. 9, 2009

(30) Foreign Application Priority Data

Nov. 2, 2004 (EP) ..... 04292595

(51) Int. Cl.
*E21B 33/138* (2006.01)

(52) U.S. Cl.
USPC ..... 166/305.1; 166/177.5

(58) Field of Classification Search
CPC ..... E21B 29/00; E21B 33/13; E21B 33/138; E21B 29/02
USPC ..... 166/279, 305.1, 177.5
See application file for complete search history.

(56) References Cited

U.S. PATENT DOCUMENTS

| | | | | | |
|---|---|---|---|---|---|
| 2,381,929 | A | * | 8/1945 | Schlumberger | 166/55.1 |
| 2,526,695 | A | * | 10/1950 | Schlumberger | 166/55.1 |
| 3,174,547 | A | * | 3/1965 | Fields | 175/4 |
| 3,542,141 | A | * | 11/1970 | Voetter | 175/4.52 |
| 4,158,388 | A | * | 6/1979 | Owen et al. | 166/286 |
| 4,768,899 | A | * | 9/1988 | Dysarz | 405/195.1 |
| 5,195,588 | A | * | 3/1993 | Dave | 166/264 |
| 5,582,251 | A | | 12/1996 | Bailey et al. | |
| 5,875,840 | A | * | 3/1999 | Dietle | 166/55 |

(Continued)

FOREIGN PATENT DOCUMENTS

| | | |
|---|---|---|
| GB | 2353 055 | 2/2001 |
| GB | 2389601 | 12/2003 |

*Primary Examiner* — Jennifer H Gay
*Assistant Examiner* — Elizabeth Gitlin
(74) *Attorney, Agent, or Firm* — Stephanie Chi; Jody DeStefanis

(57) ABSTRACT

A well treatment tool, comprising: a tool body; a clamping system for locating the tool body in a well; a positioning system for orienting the tool body in the well axially and azimuthally; a reservoir system comprising at least one fluid reservoir in the tool body; and a pumping system for pumping fluid from the reservoir to a region of the well to be treated. The treatment tool can also re-established the isolation performance of the casing, when modified (by drilling) for the treatment. The treatment tool is normally conveyed and controlled via the mean of an electrical wireline cable.

4 Claims, 5 Drawing Sheets

(56) References Cited

U.S. PATENT DOCUMENTS

| | | | | |
|---|---|---|---|---|
| 6,378,611 | B1 * | 4/2002 | Helderle | 166/311 |
| 6,729,398 | B2 * | 5/2004 | Ringgenberg et al. | 166/250.01 |
| 7,422,060 | B2 * | 9/2008 | Hammami et al. | 166/281 |
| 7,905,286 | B2 * | 3/2011 | Moody et al. | 166/298 |
| 8,079,415 | B2 * | 12/2011 | Cook | 166/277 |
| 8,118,099 | B2 * | 2/2012 | Moody et al. | 166/298 |
| 2005/0150692 | A1 * | 7/2005 | Ballantyne et al. | 175/61 |
| 2009/0173500 | A1 * | 7/2009 | Orban et al. | 166/298 |

* cited by examiner

METHOD AND APPARATUS FOR WELL TREATMENT

This invention relates to techniques and apparatus for treating wells, in particular for the treatment of zonal isolation problems in well such as oil or gas wells. The invention allows remediation of cement faults in cased wells and the placement of cement around casing in difficult situations.

Primary cementing operations in oil and gas wells are performed to after the well has been drilled and locate a casing, typically a steel tubular casing, in the well to provide zonal isolation and physical support. After primary cementing operation, various faults may be present in the cement sheath between the casing and the formation through which the borehole has been drilled to form the well. These faults include unwanted fluid communication (or leaks) through the annulus behind the casing due to channels in the cement sheath, micro-annulus behind casing, de-bonding between cement sheath and formation (borehole wall) and channels formed in the cement sheath due to gas migration during setting and vertical fractures in the cement sheath due to pressure and temperature cycling during the life of the well; and localised lack of cement sheath around the casing due to free-water separation during cement placement and failure to displace drilling mud or mud and cuttings left in deep washouts in the borehole or on the low side of lateral boreholes prior to cement placement.

These are just a few examples of the faults that can occur. The effect of these faults is that fluid flow becomes possible between regions of the well, for example water entering the production stream, gas being produced to surface outside the casing, contamination of drinking water reservoirs by hydrocarbons or deeper, unpotable water, etc.

In conventional repair techniques, the faults are located either via pressure testing or by wireline logging techniques (for example using acoustic logging tools). Once the fault is located, the casing is perforated with conventional wireline (or other conveyance such as coiled tubing or drill pipe) explosive perforation guns to provide communication from the inside to the outside of the casing. The wireline cable and tools are then removed from the well. Drill pipes, tubing or coiled tubing are then lowered into the well to a depth slightly below the area to fill. Cement slurry is placed in the casing in front of the zone to repair through this pipe. The amount of slurry pumped is often quite large. The pipe is then normally pulled out of the cement. Pressure is then applied to the cement in the well to squeeze it into the leak path via the perforations. Finally, the well is cleaned up to remove any excess of cement slurry: this is typically performed by reverse circulation into the drill-pipe or tubing. In some applications, packers and/or bridge plugs may be used to apply the squeeze pressure only on a section of the well near the repair zone.

A number of limitations of this process exist, including: poor positioning of the treatment tools and cement, lack of control of the perforation process and a generally slow procedure. These limitations can lead to loss of isolation between the formation and the annulus and well interior, despite the apparent repair, due to leakage or fracturing. Problems can also occur in the execution of the job, such as stuck pipe, plugging of the well or leaving dirty casing after the job. The process is particularly inefficient if multiple zones need to be repaired.

The thickness of annulus to be filled is often quite narrow and its theoretical volume is extremely small (for a 100 micron gap behind a 7" (17.8 cm) casing, the volume is approximately 20 $cm^3$ per meter of annulus). Cement slurry cannot flow easily through this annulus. At the most, 2 to 4 inches (5-10 cm) could be vertically filled before the required pumping pressure reaches a sufficiently high level that the pressure in the annulus can generate fractures in the cement sheath and the rock around the well. In such a case, the slurry then flows towards the formation rather than into the cement fault. Thanks to this fracture, the new slurry may pressurize the initial cement sheet against the casing, temporarily closing the micro-annulus without effecting full repair.

Certain types of damage may remain after such repair jobs.

The volume of slurry required to fill a channel is typically small, for example, 1.2 liter per meter for a 5 cm wide, 2.5 cm thick channel. Typically 20 to 50 BBL is used, most of which is circulated back to the surface after the injection.

Gas channels formed during cement setting are usually quite small. They are normally found at the formation/cement interface or on the high side of the well-bore for an inclined well. Due to their size and position in the cement sheath, they are probably not detected by most existing wireline acoustic tools. The lack of isolation generated by these paths is generally critical for gas flow.

Current squeeze techniques work for plugging existing perforations that produce un-wanted fluids (water, gas). Where an intermediate section of perforations need to be shut-off, packers and bridge plugs are used to limit the interval to squeeze. This is time consuming, especially if multiple zones need to be plugged.

In various well conditions, it may be required to ensure top quality isolation behind the casing over only a certain zone, for example at a casing shoe of an intermediate casing, when it is expected to encounter high formation pressure during the following drilling. Another application would be to ensure top quality isolation between two formations where isolation is highly critical, for example, isolation across a cap rock of a high-pressure reservoir situated below a depleted reservoir. With existing techniques, this localized high quality cement is difficult to achieve, such that the cement has to be extended over long length of the annulus to achieve the desired seal. This may generate problems (such as increase hydrostatic pressure during placement with high risk of fracture). Another common situation is to ensure good quality of the cement near a liner hanger.

Slotted liner is a common completion technique. This technique is easy to install and relatively low cost. However, it is well recognized that shutting-off unwanted zones is extremely difficult since it is difficult to confine cement slurry in the desired region outside the liner.

It is an object of the present invention to provide method and apparatus that address some or all of the problems discussed above.

A first aspect of the invention provides a well treatment tool, comprising:

- a tool body;
- a clamping system for locating the tool body in a well;
- a positioning system for orienting the tool body in the well axially and azimuthally;
- a reservoir system comprising at least one fluid reservoir in the tool body; and
- a pumping system for pumping fluid from the reservoir to a region of the well to be treated.

The tool can also include a drilling device for drilling into the wall of the well and a plugging device for plugging the hole drilled by the drilling device.

The tool can also include a pad having a port for application against the wall of the well to apply the fluid to the region to be treated. Preferably, the pad comprises a packer surrounding the port to isolate the port from other fluids in the borehole when a the pad is applied to the wall of the well.

The drilling device and the pad can be provided at separate locations on the tool body, separated axially or azimuthally on the tool body. The drilling device and the pad can alternatively be at substantially the same location on the tool body.

The reservoir system preferably comprises multiple reservoirs and the pumping system includes valves allowing selective pumping of fluids from separate reservoirs.

A mixing system can be included for mixing fluids from the reservoirs. The mixing system can comprise a mixing chamber having a roller system located therein for mixing fluids introduced into the chamber, or a valve system allowing fluids to be pumped back and forth between two reservoirs.

In certain cases, it can be desirable to include a dilution system including a first port near to the tool body, a second port remote from the tool body, a channel connecting the ports and a pump in the channel for pumping well fluids from the well near the second port to the well near the first port.

In an embodiment particularly suitable for use in cementing lateral wells, the pumping system comprises a conduit extending from the tool body to a region of the well to be treated. A packer can be mounted on the conduit for sealing inside the well to isolate the region to be treated.

Sensors can be included for locating faults in a cement sheath surrounding the well and for monitoring the flow of treatment fluid, for example to detect the presence of treatment fluid in the well.

A second aspect of the invention provides a method of treating a well, comprising:

positioning a tool in the well at a region to be treated;

locking the tool in place with a clamping system;

orienting the tool axially and azimuthally with a positioning system;

pumping fluid from a reservoir in the tool to a region of the well to be treated with a pumping system.

Preferably, the method further comprised drilling a hole into the wall of the well prior to pumping fluid, and sealing the hole after pumping. The tool can be reoriented after drilling and before pumping and after pumping and before sealing.

A particularly preferred method according to the invention comprises drilling at least two separated holes in the wall of the well and circulating treatment fluid from one hole to the other. The holes can be azimuthally separated, or axially separated holes in which case treatment fluid is preferably circulated from a first hole to an second hole (the first hole is typically below or closer to the bottom of the well than the second hole). The pumping can be controlled by sensing treatment fluids exiting from the other hole and controlling pumping accordingly.

The pumping step preferably includes mixing fluids in the tool. This can be done by delivering the fluids to a mixing chamber and mixing the fluids in the chamber by means of a roller system, or by pumping fluids back and forth between two reservoirs.

It is also preferred to pump cleaning fluid through the tool after the treatment fluid has been pumped to prevent blocking of the tool by the treatment fluid.

Well fluid can be pumped around the region to be treated to dilute any treatment fluids entering the well.

Where the region of the well to be treated is a fault in a cement sheath surrounding the well, the method preferably further comprises measuring the size, shape and type of fault prior to treatment. The measurement can be repeated after treatment and treatment and measurement repeated until a satisfactory result is achieved.

By measuring the operation of the tool, the operation of the tool can be controlled accordingly.

One embodiment of the invention comprises pumping the treatment fluid to a region of the well remote from the tool by means of a conduit connected to the tool. Where the remote region is a lateral hole drilled from a main borehole, the method can comprise locating the tool in the main well and pumping treatment fluid into the lateral by means of the conduit. The remote region of the well can be isolated by means of a packer mounted on the conduit.

The method preferably includes repeating the positioning, locking, orienting and pumping at different locations in the well. Where the well has a slotted liner, the method can include repeating the steps at the location of different slots in the liner.

Figure 8:
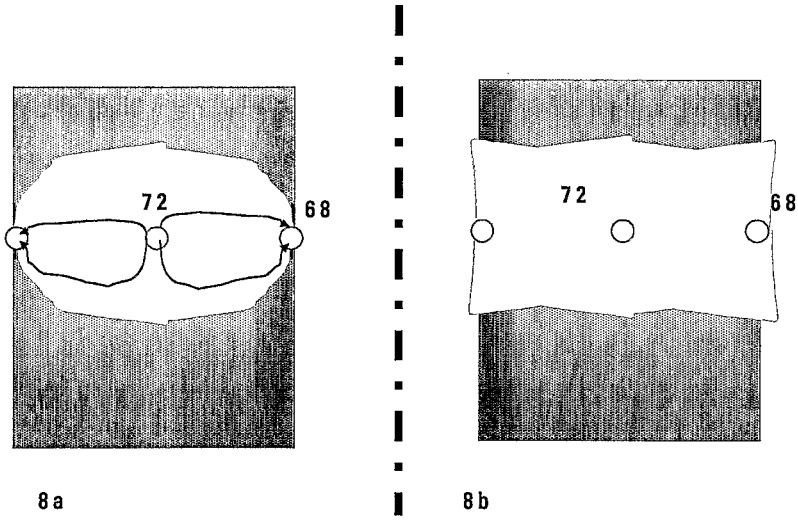

FIGS. 8*a* and 8*b* show the pattern of slurry placement behind multiple injection parts as an isolation ring through a specific depth.

Figure 9:
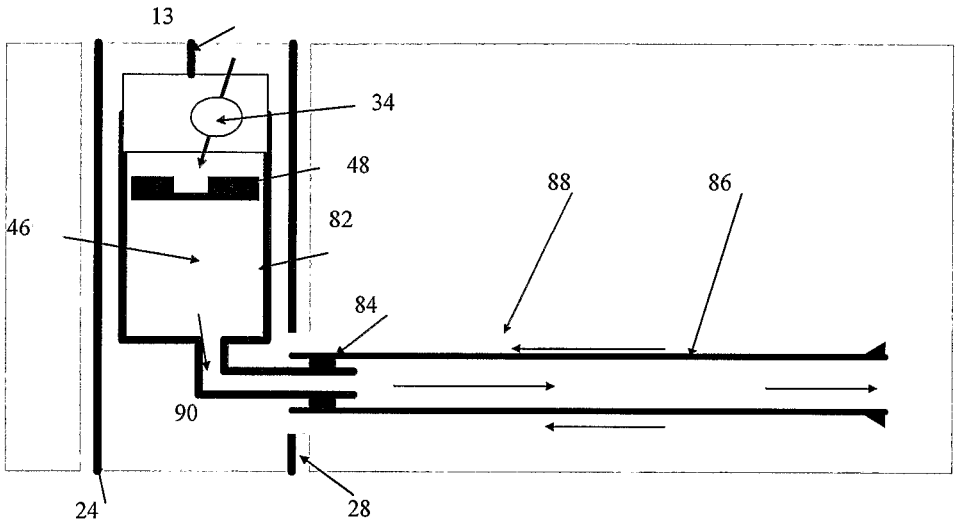

FIG. 9 shows completion of a lateral wall.

The basic operation of a wireline tool for well isolation according to the invention is set out tubular.

The tool can be run in the well in association with conventional logging tool to determine the proper location of the operation. For a remedial cement job, an imaging acoustic logging tool capable of locating cement faults behind the casing is preferred. Other techniques than acoustic can be used (azimuthal density, noise tool for leak detection behind the casing, . . . ). For intervention in a lateral hole junction, an imaging tool is also preferred. For placing a cement isolation ring behind a tubular, a tool to log natural gamma-ray or a CCL (Casing Collar Locator) is preferred.

The defect can be detected in the previous run of a locating tool, but it is highly advantageous to combine the logging device with the remedial device leading to time saving accurate placement of the remedial process, and re-evaluation of the cement sheath after the remedial job.

Figure 1:
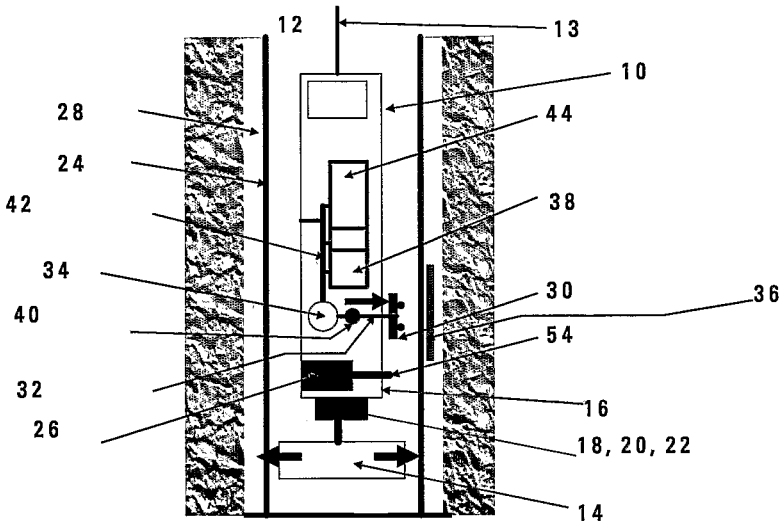
FIG. 1 shows one embodiment of a tool relating to the invention.

Referring to FIG. 1, when the tool 10 is suspended at the proper location in the well 12 by means of a wireline cable 13, a clamping system 14 locks the tool 10 in the well-bore by a slips system or the extension of radial clamps. The tool then positions its working head 16 at the proper location by means of an integrated positioning mechanism 18 comprising an orienting swivel 20, and a sliding system 22 for axial displacement. These two movements can be operated at high accuracy. One implementation of this comprises a "no-slippage" crawling tractor and an orienting sub. The tractor locks the system in place in a static position, but can make small controlled axial displacements. The orienting sub performs the azimuthal orientation.

After the proper positioning of the working head 16, the following steps ensure communication with the outside of the tubular casing 24 in the well. A hole is drilled through the tubular (casing) 24 by a drilling system 26 which rotates a drill bit while applying a radial displacement (and force). The drill bit can be driven through the thickness of the initial well annulus behind the casing 24 to ensure the proper communication with the annulus. In case of repair of a casing micro-annulus, this extension of the drilled hole into the cement sheath 28 is normally limited to a minimum. For this drilling operations, a device similar to the Schlumberger Cased-Hole Dynamic Tester (CHDT) drilling system can be used.

A sealing pad 30 with a central injection port 32 is then applied by the tool 10 against the casing 24. The injection port 32 is aligned with drilled hole in the casing 24. The injection port 32 can be concentric with the drilling system 26. With such an arrangement, the tool 10 remains at the same location for all functions. Alternatively, the drilling system 26 may be separated from the sealing pad 30 and the injection port 32. In this case, the tool 10 moves to position each active element in front of the desired location when needed. The displacement can be performed via either the linear 22 or the azimuthal 18 displacement system without unclamping the locking system 14

A tool with two different active sections (one for drilling, one for sealing and pumping) has the advantage of cleaning and maintenance, as either aggressive fluids or hardening fluids may be pumped through the injection port.

After the pad application, the tool 10 activates its internal pump 34 to circulate and pressurize fluid in the defective area 36 behind the casing 24. This allows the verification of the injectivity behind the casing which is a critical step for a successful cement placement. The fluid used for this injection test can be pumped either from the main well-bore 12 or from a reservoir 38 inside the tool. The injectivity is monitored by means of a pressure transducer and flow measurement device 40.

When the injectivity has been proven, clean-up of the fluid in the volume to inject is performed by pumping adequate fluid at proper flow rate. For the most simple application, the clean-up fluid is taken from the main well-bore 12 (via an intake manifold 42, with the appropriate valve in an open position). However, in the preferred embodiment, the clean-up fluid is taken from the reservoir 38. This fluid can an appropriate chemical composition to achieve the clean-up: water, solvent, acid, etc.

Figure 2:
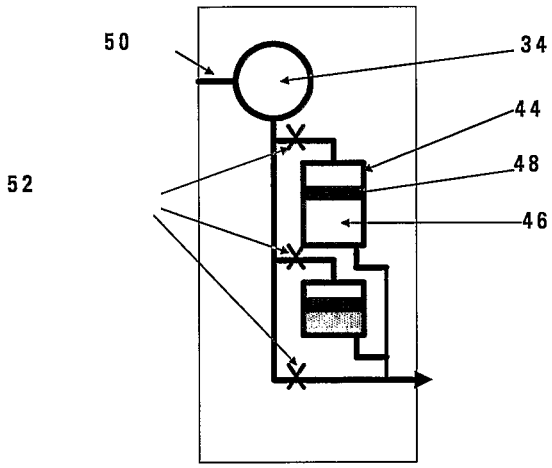
FIG. 2 shows a schematic view of a reservoir and pump section of a tool.

When the clean-up of the defective area 36 is completed, cement slurry is pumped in the volume to inject behind the casing 24. The slurry is pumped from a reservoir 44 inside the tool 10 through the port 32 of the sealing pad 30 into the drilled hole of the casing 24. The injection parameters such as pressure and flow rate are monitored. The pumping effect of the slurry 46 may be achieved by pushing a separation piston 48 in the slurry chamber 44 (FIG. 2). This ensures that the pump 34 only handles clean fluid. When the injection is completed, bore-hole fluid is injected, via an intake 50 through most pipes and valves 52 to ensure proper clean-up and avoid hardening of slurry in the pipes causing plugging.

When the slurry has hardened in the injected volume behind casing 24, the tool performs a further injectivity test. If the first injection of the slurry achieved a successful repair, no further injection should be possible. The tool then plugs the hole in the casing 24, for example by inserting a plug or rivet 54 in a similar manner to the Schlumberger Cased-Hole Dynamic Tested (CHDT). Plugging can also be achieved by the installation of a short section of an expandable structure, for example a short metal pipe expanded inside the casing diameter.

If the first repair attempt fails (as indicated by the further injectivity test), the tool can re-initiate a new slurry injection cycle and test. Multiple cycles may be required for perfect isolation.

The tool can pump multiple fluids with minimum interaction between them. Typically, the first fluid to pump behind the casing is for the injectivity test. It can be either fluid from the main well-bore, or it can be a specific fluid to avoid contamination of the volume to treat behind the casing 24. Such a fluid can be clear brine, acid, or solvent, contained in a reservoir of the tool. A particular reservoir 44 holds the slurry to inject behind the casing 24.

Inside the tool, a manifold 42 allows the connection of the desired reservoir to the injection port 32. In the preferred embodiment (FIG. 2), the fluid does not pass through the pump 34 The pump 34 delivers fluid from the main bore-hole 12 to the back of a separation piston 48 of the selected reservoir: A manifold 42 connects the discharge of the pump 34 on to the reservoir.

Also in the preferred embodiment, the reservoirs are maintained at the hydrostatic pressure of the bore-hole. In one embodiment, this can be achieved by applying the well pressure on top of the separation piston 48 (by opening the appropriate valves 52.

In some applications, it may be advantageous to finalize the slurry preparation just before its use. This final preparation can comprise adapting the slurry rheology or triggering the setting of the slurry (or accelerating its setting). For this purpose, chemical can be mixed with the slurry just before its injection. Multiple mixing systems are possible.

Figure 3:
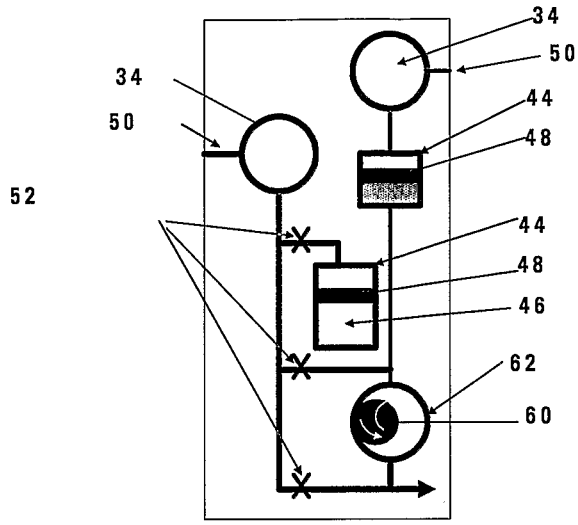
FIG. 3 shows a mixing section.

In one embodiment, the mixing is achieved by simply delivering two or more products via a T intersection connected to the port 32. After the intersection (and before the exit of the injection port 32), a mixer insures the adequate homogeneity of the fluid. In the case of "liquid" slurry, a static mixer may be sufficient; but for a paste, the mixing can be performed by deforming the paste with moving system (such as an eccentric rollers 60 in a cylindrical chamber 62) (FIG. 3). The roller(s) 60 rolls against the wall of the mixing chamber 62. Thus the rollers 60 rotate on themselves and simultaneously around the centre of the mixing chamber 62.

Figure 4:
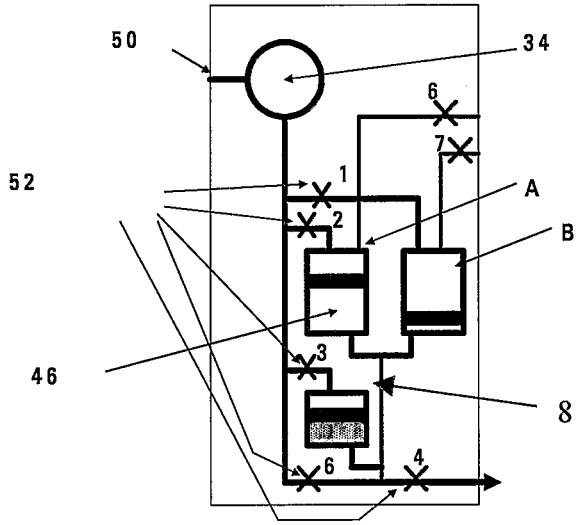
FIG. 4 shows an alternative mixing section.

Another mixing process is based on a system of three chambers (FIG. 4). With this system, two similar reservoirs (A & B) are used: one is filled with slurry; the other one is empty (or both are half filled). The first step is to inject the chemical by pumping well fluid through valve 3. As the exhaust valves (6 & 7) of reservoir A and B are open, the chemical is placed in contact with the slurry via the transfer channel 8 (all the other valves are closed during this chemical injection phase). The chemical injection is stopped after proper dosing. Then the slurry with the chemical will be transferred multiple times from reservoir A to B and back. This is achieved by activating the pump 34 through either valves 1 or 2, while the exhaust valve (6 or 7) of the other reservoir is open. The transfer action ensures proper homogenization of the slurry with the chemical. Finally, the slurry can be pumped from the tool through valve 4 by simultaneously opening valves 1 and 2 (while valves 6 and 7 are closed) (the other valves also being closed). The other valves can be used for other operations such as injection test or clean-up. The dosing of the multiple products is achieved by the proportionality of the pumped fluid on the reverse side of the separation pistons 48, 48' in the relevant reservoirs 44, 44' (FIG. 3). This proportionality can be achieved using a volumetric pump such as progressive cavity pump.

The cleaning of the section filled by "ready to set" slurry is important. This cleaning is important in all zones of the tool after the mixing of the setting agent, as the slurry should set in a time before the tool is pulled out of the well. The cleaning is achieved by circulating cleaning agent and solvent through the critical zone of the tool. These chemicals are contained within reservoirs of the tool. Final cleaning can be achieved by pumping fluid from the borehole through the tool. All the fluids used to clean the machine are rejected into the main well-bore 12.

Figure 5:
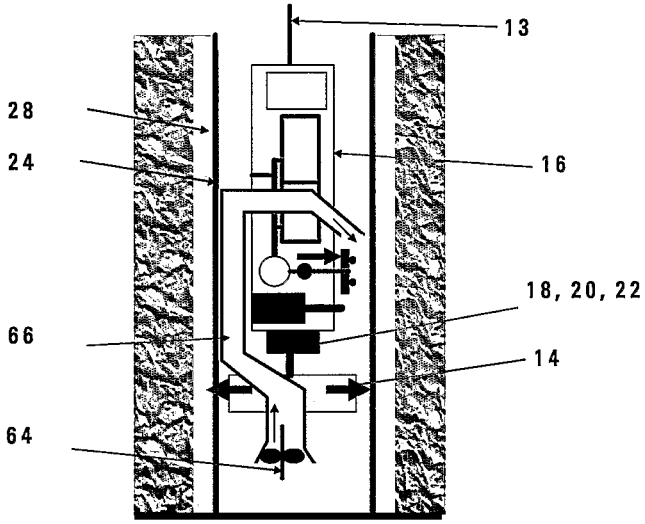
FIG. 5 shows a dilution system.

After the operation of the tool, the fluid in the borehole is partially polluted. In particular, the cleaning fluids for the machine are rejected in the borehole. After the injection, slurry may also be present in borehole. Normally the wellbore should stay clean as the packer pad 30 guides the slurry from the tool to the drilled hole in the casing 24. However in case of packer leakage or failure, some slurry may be injected from the tool into the well bore. To limit the inconvenience of pollution of the well bore, the tool can be equipped with a diluting system (FIG. 5). This system comprises a diluting pump 64 extended by a long discharge tube 66. The pump 64 sucks the well-bore fluid near the packer and forces it into the tube 66 which guides the fluid far away of (and below) the tool. Fluid circulation is established in the casing 24 outside the tube 66. The pump 64 comprises of one or more high-speed propellers which mixes the slurry with the bore-hole fluid and ensures dilution. The diluted fluid may be circulated multiple times through the pump 64 via the tube 66. This dilution ensures that the slurry cannot set in large block within the wellbore, while cleaning fluids (solvent, acid, . . . ) are also diluted.

The drilled hole (for squeeze) is plugged by the tool at the end of the job. In the preferred embodiment, the plugging is achieved by a metal plug forced into the drilled hole (as with the Schlumberger Cased-Hole-Dynamic-Tester). However, the hole has to be cleaned before the insertion of the plug, as slurry may have hardened in it. The cleaning can be performed by either re-running the drill bit in the hole, or by honing or reaming the hole by a slightly larger bit.

The plugging of the hole can also be achieved by the lining the casing of the well with a thin tubular. This tubular can be a metal tube expended to casing diameter. The expansion can be simplified by the use of a corrugated sleeve. The sleeve could also be a down-hole cured patch of resin and fibre (such as the PATCHFLEX system from DRILLFLEX).

The tool is designed to perform the injection of slurry behind the tubular in multiple cycles. This allows proper filling of the volume behind the tubular even when initially filled with highly gelled fluid. In some situations, the first injection may only replace part of the gelled fluid by slurry. After the setting of the slurry, additional cycles of injectivity test, slurry injection and "wait for curing" period may be needed to achieve the perfect filling and isolation. Between these cycles, the machine performs internal clean-up of its mixing and injection system.

The tool is designed to accomplish multiple construction or repair jobs in one single trip in the well. The multiple jobs are often at different depths. However, in some situations, the jobs can be performed at the same depth but at different azimuths. The number of jobs is limited by the amounts of fluid stored in the machine reservoirs.

In certain situations, it is advantageous to ensure fluid circulation in the volume to treat behind the casing. For example, the filling of a channel left after of primary cement job, circulation across the length of the channel greatly improves the quality of the repair. The circulation can be established properly only when an exit port is being made across the casing at the opposite extremity of the volume to treat.

Figure 6:
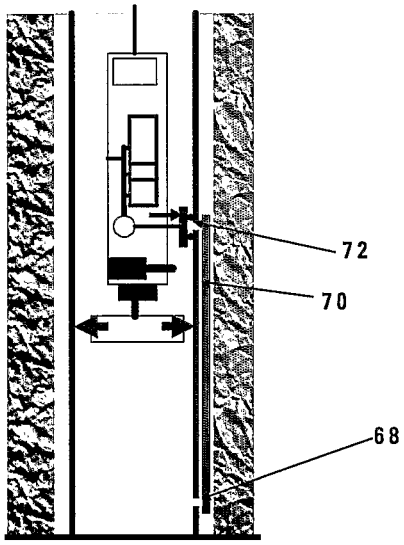
FIG. 6 shows a tool in operation with circulation.

The tool is able to drill the exit port at one extremity of the defective volume to treat, in which case a detection technique is combined with the repair tool. In particular, depth and azimuth are tracked during the whole process. Also it is preferred to position the exit port at the lower depth to reduce any risk of tool and cable sticking within circulated fluid. Following drilling of the exit port 68, the tool is unclamped and moved to another depth corresponding to the other extremity of the volume to treat 70. At this new position, the tool is clamped in place to perform the job (drilling, circulation, slurry placement, rivet installation) 72 (FIG. 6). This operation is performed in a manner similar to the treatment without circulation: however, the circulation volume for clean-up is typically larger and pumped at higher flow rate. The proper and complete treatment may have to be performed in multiple steps (clean-up, slurry placement, wait on setting, injectivity test) to achieve full filling of the cavity behind the tubular.

After plugging of the injection port 72 with a rivet, the tool has to be re-positioned in front of the other hole 70 to install the plug (or rivet) in the casing 24. This means that the tool must be equipped with proper re-positioning system: The system can include (or be associated with) an imaging tool to locate the hole (ultrasonic imaging) The tool displacement must be well-controlled to allow to slide the machine from the imaging position (to find the hole) to the working head position (to install the rivet. This accurate displacement can achieved either with a tractor measuring the linear displacement. The working head 16 may be equipped with sensing device(s) (such as finger(s)) to sense the surface and locate the small hole. Other locating techniques are also possible. One particular technique is to install a locating system in the casing. This system can be based on the concept of retrieval locking devices equipped with slips (as used in retrieval bridge plugs). This system can be locked into the casing at the proper depth by the tool. This locked device is equipped with a system so that the tool can return to the same depth and the same azimuth. To find the same azimuth, the casing locating system can be equipped with a "mule shoe" device as used inside drill collar for locating fishable MWD tools. After multiple relocations of the tool, the tool can unset the casing locating device and fish it. The same device can be re-installed at an another location for other remedial tasks.

Figure 7:
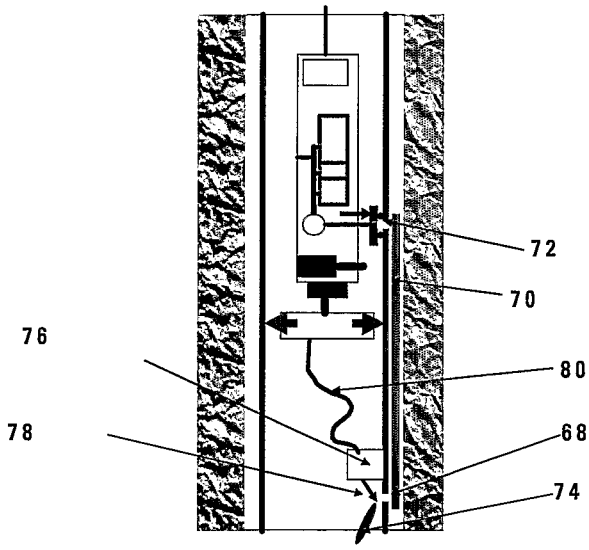
FIG. 7 shows a further embodiment of a tool with circulation.

When circulation is allowed by virtue of the two (or more) holes, it is important to monitor the fluid 74 circulated out of the exit port 72 back into the casing 24 (FIG. 7). During the clean-up phase, this monitoring allows detection of clean returned fluid 74, so that the clean-up can be stopped.

During slurry placement, it may be vital to limit the amount of slurry re-entering the internal bore of the casing 24, to avoid major contamination by hardening slurry inside the casing.

Monitoring can be performed by a instrumented device 76 left near the exit port 68. This device may include as sensors 78 pH meter, flow meter, colour monitoring device, etc. The device 76 can be clamped onto the casing 24. This clamping can be performed by mechanical slip or latch system or by magnetic clamping. The monitoring device 76 can be a shuttle of the tool 10 connected via an electrical cable 80 for power and signal communication. Alternatively, it can be an independent device equipped with battery and use wireless communication with the main tool 10.

Channels behind casing are typically filled with gelled mud which was not displaced during primary cementing. Even when the two-hole process described above is being used to ensure good circulation in the volume behind the casing, it is difficult to displace the mud properly over the full section of the channel. In certain cases, acid may help to break the mud. Vibration is foreseen as an efficient technique to break the gel during circulation. The flow for the circulation is pulsed at high amplitude. These vibrations can be generated by rotary valve limiting the flow, similar to a mud-pulse siren used for MWD telemetry.

The tool can also be used to place a ring of slurry behind a solid casing. This technique can be advantageous to place high quality slurry in specific area where slurry pollution should be minimized. An example of this situation is the placement of high quality isolation ring in front of the cap rock above the oil & gas reservoir. For this application, the two-hole process is used with the holes being drilled at the same (or similar) depth but a different azimuth. The fluid injection is then performed in circumferential flow behind the casing.

The clean-up of the annulus outside the casing should be performed by sufficient fluid flow, but the contact time between the cleaning fluid and the gelled mud is often limited as the volume of fluid is limited to avoid large volume contamination in the main bore-hole by the fluid exiting the exit port. The contact time can be largely improved by the introduction of new circulation system. In one embodiment, the process collects the retuned fluid in a return tank. A second pad and packer are set at the exit port to allow collection of the exiting fluid in a return tank. When no additional storage in return tank is available, the additional fluid is discharged into the main well-bore via a by-pass valve. A further embodiment is based on the used of magnetic fluid. For this application the cleaning fluid (and/or the slurry) is injected with magnetic particles. The slurry is placed in the annular ring by conventional pumping through one port (and returns via the other port). When the fluid is properly placed, the tool positions a rotor in the main bore-hole at the depth of the slurry annular ring. This rotor is equipped with high strength magnets with their poles typically aligned in a radial direction. The machine sets the magnets in rotation, generating rotating magnetic flux that ensures some attraction onto the magnetic particles in the fluid of the annular ring, creating fluid rotation in the annulus. This fluid rotation in the annulus will stay active as long as the magnetic rotor of the tool is turning. This allows large contact time between the moving cleaning fluid and the gelled mud in the annulus for optimum cleaning of the annulus.

As described above, slurry is injected and circulated behind the casing to form a sealing ring via the use of two ports (or communication holes). The slurry is injected through one of these ports while fluids from behind the casing flow into the casing by the other ports. The flowing pattern is not uniform behind the casing, the flow line diverging around the injection port 72 and converging towards the exit port(s) 68. This means that the slurry may not form an uniform ring behind the casing, it may be wider near the injection port and may have limited extension near the exit port (see FIG. 8*a*). This limited sealing extension near one port may be a source of leakage from the bottom of the annulus towards the top part of the annulus (or reverse).

To reduce this issue, a second slurry injection will be performed from the other port 68, previously the exit port (the role of the port is changed). This reversed placement allows an extension of the ring of cement near both ports 68, 72. When the slurry placement is completed, the ports 68, 72 may be plugged with a metal plug as described above Cement placement behind the casing is a complex operation. The tool can monitor (and transmit to the surface in real-time) various parameters to ensure the job quality, including depth and azimuth of the drilled holes; pumping parameters for each fluids at each phase: pressure, flow rate, pumped volume, temperature; and parameters of the returned fluids near the exit port. Parameters monitored to identify the returned fluid can include pH and resitivity. Furthermore, flow rate can be monitored to determine the amount of fluid lost in the formation. An acoustic image of the cement sheath behind the casing before and after the treatment process can be used to determine the efficiency of the treatment. The acoustic image of the inside of the well-bore can also be used to determine the status of the casing before the job, the performance of the cleaning of the casing internal bore after the job and the proper installation of the plugs in the hole.

The tool according to the invention can also be used within slotted liners. The injection pad 30 is applied against the liner in front of one slot. Slurry is injected behind the slotted liner. After some injection, the injection pad 30 is retracted and rotated towards another slot. Slurry injection is then re-started. This process of pad setting followed by injection is repeated multiple times for most of the slots at the same depth of the slotted liner. These successive injections via the slots at a given depth build a slurry ring behind the slotted liner. After the full coverage at one depth, the injection process is started at the next depth of slots to start another slurry ring. As the spacing between successive ring of slots is small, the slurry rings touch each other to form a nearly continuous sheet of slurry behind the liner. This process can be continued over some length of liner to ensure proper sealing of the annulus over some distance.

In this case, the viscosity of the slurry can be made relatively high so as to act more as a paste and ensure proper filling of the full thickness of the annulus. It might be necessary to circulate fluid inside the well bore to insure cleaning of any slurry flowing into the inside of the liner. This can be achieved by the same mechanism (66, 64) as the cleaning performed near the ports used during injection behind casing.

The placement of these successive rings can start from the bottom of the zone to treat moving slowly upwards. This limits the risk of tool sticking in slurry accidentally flowing inside the liner.

Lateral well drilling is become more common. Liners may be installed in these laterals, requiring cement operations with small amounts of slurry. If the slurry volume is small, it may be useful to use the tool according to the invention to handle cement slurry to ensure accurate placement of the slurry behind the liner. A tool adapted to these requirements is shown in FIG. 9. Compared to the tool described above, it has a slightly larger reservoir 82 and uses a sealing device (packer) 84 for connection into the top of the liner 86. In the embodiment shown, the tool body remains in the main well 12 and slurry is pumped from the reservoir 82 to the lateral 88 via a stinger 90 which passes through the packer 84.

In use, the fluid returning from the lateral 88 is monitored to detect the presence of slurry. The pump can be connected directly to the liner 86 (by-passing the slurry reservoir 82) to allow the displacement of the slurry in the liner 86. The liner 86 may be equipped with a bottom plug when starting the cement job.

The tool can also be used in open hole in case of lost circulation to place a sealing fluid at the proper place. This can be valuable in carbonate to seal fractures which can be identified in the same run with an imaging tool. Thanks to proper placement, damage to the reservoir will be limited.

It will be appreciated that a number of changes can be made to the tool depending on uses while retaining the basic concept of the invention.

The invention claimed is:

1. A method of repairing a well having a casing, comprising:

positioning a tool in the well;

locking the tool in place with a clamping system;

orienting the tool axially and azimuthally with a positioning system;

drilling a hole through the casing into a region behind the casing to be treated with a drilling device having a drill bit;

pumping a repair fluid from a reservoir in the tool to the region behind the casing for repairing a cement fault in said region with a pumping system, wherein the repair fluid includes magnetic particles and the tool includes a rotor with magnets having poles aligned in a radial direction;

rotating the magnets once the repair fluid has been pumped into an annulus region behind the casing to be repaired so as to generate a magnetic flux creating fluid flow in the annulus and a ring of fluid; and plugging the hole drilled in the casing with a plugging device after the cement fault in the region behind the casing has been repaired.

2. A well treatment tool, comprising:

a tool body;

a clamping system for locating the tool body in a well having a casing;

a positioning system for orienting the tool body in the well axially and azimuthally;

a reservoir system comprising at least one fluid reservoir in the tool body;

a drilling device having a drill bit for drilling a hole through the casing into a region behind the casing to be repaired;

a pumping system for pumping a repair fluid from the reservoir to the region behind the casing for repairing a cement fault in said region;

a plugging device for plugging the hole drilled in the casing after the cement fault in the region behind the casing has been repaired; and a controller to first activate the pumping system to pump the repair fluid from the reservoir into the region behind the casing and thereafter to cause the plugging device to plug the hole drilled in the casing.

3. A tool as claimed in claim 2, wherein the controller causes the tool to perform an injectivity test prior to activating the pumping system, and only if the injectivity test indicates a defect behind the casing proceeding with activating the pumping system.

4. A tool as claimed in claim 2, wherein verifying performing an injectivity test and pumping the repair fluid into the region behind the casing are iteratively performed until the injectivity test indicates a successful repair, and the controller causes the plugging device to plug the hole only after the injectivity test indicates a successful repair.

* * * * *